US005244769A

United States Patent [19]

Yanagihara et al.

[11] Patent Number: 5,244,769

[45] Date of Patent: Sep. 14, 1993

[54] LIGHT-SENSITIVE IMAGE FORMING MATERIAL

[75] Inventors: Naoto Yanagihara; Akihiko Takeda; Akira Igarashi, all of Shizuoka, Japan

[73] Assignee: Fuji Photo Film Co., Ltd., Kanagawa, Japan

[21] Appl. No.: 665,844

[22] Filed: Mar. 7, 1991

[30] Foreign Application Priority Data

Mar. 8, 1990 [JP] Japan ..... 2-57660

[51] Int. Cl.[5] ..... G03C 1/73

[52] U.S. Cl. ..... 430/138; 430/343; 430/346; 430/332; 549/226; 503/218

[58] Field of Search ..... 430/343, 346, 332, 334, 430/138; 549/223, 224, 225, 226, 227; 503/218

[56] References Cited

U.S. PATENT DOCUMENTS 3,989,716 11/1976 Spatz ..... 549/226
4,749,796 6/1988 Sensui et al. ..... 549/225
4,962,009 10/1990 Washizu et al. ..... 430/138

*Primary Examiner*—Charles L. Bowers, Jr.
*Assistant Examiner*—John A. McPherson
*Attorney, Agent, or Firm*—Sughrue, Mion, Zinn, Macpeak & Seas

[57] ABSTRACT

A light-sensitive image-forming material is disclosed, comprising a support having thereon a recording layer containing a leuco dye which forms color upon oxidative development, a photo-oxidizing agent and a reducing agent, wherein the leuco dye is an xanthene compound having a cyclic amino group at the 2-position. The light-sensitive image-forming material of the present invention provides an image having satisfactory color density and stability to light after imagewise exposure and fixation.

11 Claims, No Drawings

LIGHT-SENSITIVE IMAGE FORMING MATERIAL

FIELD OF THE INVENTION

The present invention relates to a light-sensitive image-forming material, particularly to a fixable light-sensitive image-forming material of the leuco dye type. More particularly, the present invention relates to a light-sensitive image-forming material having excellent image stability and which develops black color.

BACKGROUND OF THE INVENTION

Light-sensitive image-forming materials useful for applications such as proof paper, print-out paper, overlay films, and the like have widely been used in various photographic applications in which imagewise exposure and development provides an image in the photosensitive portion, namely free-radical photography.

For such applications, particularly useful are materials based on the oxidative color development of a leuco dye by a change into a corresponding dye using a photo-oxidizing agent.

Such materials, which are sensitive to light, may develop color when exposed to regular room light, sunlight or white light even after a dye image has already been formed by light exposure. Such light image-forming materials are therefore not readily handleable.

Various methods has been proposed for preventing color development at the photosensitive portions which have not been exposed at a preceding imagewise exposure step to thereby retain the image thus formed including a method of applying a solution of a reducing agent such as a radical scavenger onto an image-carrying medium by spraying or immersion to retain the original image; a method of forming an image by UV light and then fixing the image by activating a photoreducing substance by visible light as described in JP-A 47-12879 (The term "JP-A" as used herein means an "unexamined published Japanese patent application") corresponding to U.S. Pat. No. 3,658,543; and a method of incorporating a reducible heat-fixing agent in the photosensitive layer or coating the agent onto the layer, and fixing by heating after the imagewise exposure as disclosed in JP-B 43-29407 (The term "JP-B" as used herein means an "examined Japanese patent publication".).

Among the leuco dyes employed in light image-forming materials, xanthene compounds which develop a black color tone are known having an anilino group at the 2-position, an alkyl group at the 3-position, and a substituted amino group at the 6-position, as described in JP-A Sho-61-137876 corresponding to U.S. Pat. No. 4,749,796.

Such compounds, however, disadvantageously do not develop sufficient color density, and are therefore not satisfactory.

SUMMARY OF THE INVENTION

An object of the present invention is to provide a light-sensitive image-forming material which develops a high color density.

The above-described object of the present invention is attained by a light-sensitive image-forming material comprising a support having thereon a recording layer containing a leuco dye which forms color upon oxidative development, a photo-oxidizing agent, a reducing agent and a binder, wherein the leuco dye is a xanthene compound having a cyclic amino group at the 2-position.

DETAILED DESCRIPTION OF THE INVENTION

The leuco dye, a component of the light-sensitive image-forming material of the present invention is a reduced form of a dye having one or two hydrogen atoms, and develops color by forming a dye either by elimination of a hydrogen atom, or in some cases by addition of a supplemental electron. Since the leuco dye is substantially colorless or pale-colored, the dye is employed as a means for forming a color image by oxidative development. In the present invention, the leuco dye is oxidized by a photo-oxidizing agent which is activated by light irradiation. The oxidizing agent reacts with the leuco dye to form a color image only on those portions of the image-forming material exposed to light.

The leuco dye having a xanthene skeleton which forms color upon oxidative development of the present invention is preferably substituted at the 9-position of the xanthene skeleton by an aromatic ring, which aromatic ring may be substituted.

The leuco dye of the present invention having a xanthene skeleton and which forms color upon oxidative development is represented by formula (I);

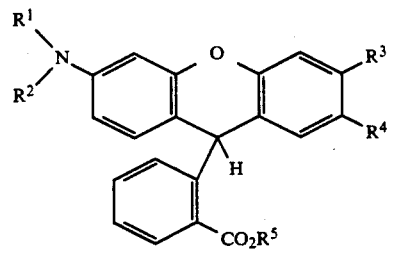

(I)

where $R^1$ and $R^2$, which may be the same or different, each represents an alkyl group having from 1 to 20 carbon atoms, an alkenyl group having from 1 to 20 carbon atoms, an alkynyl group having from 1 to 20 carbon atoms, or an aryl group having from 6 to 20 carbon atoms; $R^3$ represents an alkyl group having from 1 to 20 carbon atoms, an alkoxy group having from 1 to 20 carbon atoms, an aryl group having from 6 to 10 carbon atoms or a halogen atom; $R^4$ represents a cyclic amino group having from 3 to 20 carbon atoms; and $R^5$ represents an alkyl group having from 1 to 20 carbon atoms. The xanthene ring and the benzene ring at the 9-position thereof may have a plurality of substituents, which may be the same or different, including an alkyl group having from 1 to 10 carbon atoms, an alkenyl group having from 1 to 10 carbon atoms, an alkynyl group having from 1 to 10 carbon atoms, an aryl group having from 6 to 10 carbon atoms, a substituted amino group having from 1 to 12 carbon atoms, an alkoxy group having from 1 to 10 carbon atoms, an aryloxy group having from 6 to 10 carbon atoms, an alkylthio group having from 1 to 10 carbon atoms, a halogen atom including a fluorine atom, a chlorine atom and a bromine atom, a nitro group, a cyano group, or a hetero ring selected from

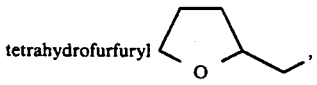

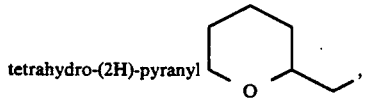

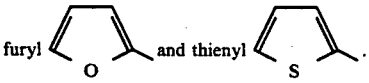

In the above formula, the groups represented by $R^1$ and $R^2$ may further be substituted by an alkyl group having from 1 to 10 carbon atoms, an alkenyl group having from 1 to 10 carbon atoms, an alkynyl group having from 1 to 10 carbon atoms, an aryl group having from 6 to 10 carbon atoms, a substituted amino group having from 1 to 12 carbon atoms, an alkoxy group having from 1 to 10 carbon atoms, an aryloxy group having from 6 to 10 carbon atoms, an alkylthio group having from 1 to 10 carbon atoms, a halogen atom including a fluorine atom, a chlorine atom and a bromine atom, a nitro group, a cyano group, or a hetero ring selected from tetrahydrofurfuryl

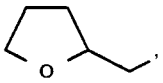

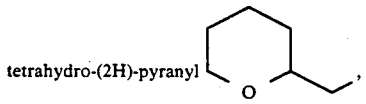

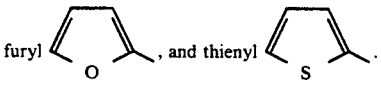

A substituted amino group is preferably an amino group substituted by an alkyl group having from 1 to 12 carbon atoms, an aryl group having from 6 to 10 carbon atoms or an acyl group having from 2 to 10 carbon atoms. These substituents may be further substituted. Specific examples of $R^1$ and $R^2$ include —H, —$CH_3$, $C_nH_{2n-1}YZ$,

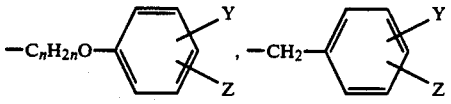

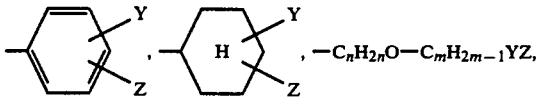

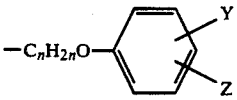

where n is an integer of from 2 to 10; m is an integer of from 1 to 5; and Y and Z may be same or different, each represents an alkyl group having from 1 to 5 to carbon atoms, an alkenyl group having from 1 to 5 carbon atoms, an alkynyl group having from 1 to 5 carbon atoms, an aryl group having from 6 to 10 carbon atoms, a hydrogen atom, a substituted amino group having from 1 to 6 carbon atoms, an alkoxy group having from 1 to 5 carbon atoms, an aryloxy group having from 6 to 10 carbon atoms, an alkylthio group having from 1 to 5 carbon atoms, a halogen atom including a fluorine atom, a chlorine atom and a bromine atom, a nitro group and a cyano group. A substituted amino group is preferably an amino group substituted by an alkyl group having from 1 to 12 carbon atoms, an aryl group having from 6 to 10 carbon atoms or an acyl group having from 2 to 10 carbon atoms.

$R^1$ and $R^2$ may be joined together to form a 4- to 7-membered ring having a hetero atom or an unsaturated bond.

In formula (I), the group represented by $R^3$ may further be substituted with an alkyl group having from 1 to 10 carbon atoms, an alkenyl group having from 1 to 10 carbon atoms, an alkynyl group having from 1 to 10 carbon atoms, an aryl group having from 6 to 10 carbon atoms, a substituted amino group having from 1 to 12 carbon atoms, an alkoxy group having from 1 to 10 carbon atoms, an aryloxy group having from 6 to 10 carbon atoms, an alkylthio group having from 1 to 10 carbon atoms, a halogen atom including a fluorine atom, a chlorine atom and a bromine atom, a nitro group, a cyano group, or a hetero ring selected from tetrahydrofurfuryl

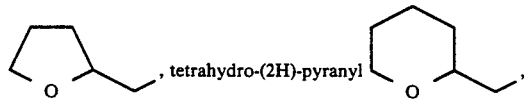

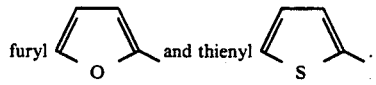

These substituents may be further substituted.

$R^3$ in formula (I) preferably is an alkyl group having from 1 to 15 carbon atoms, an alkoxy group having from 1 to 15 carbon atoms, a chlorine atom or a fluorine atom. Particularly preferable groups represented by $R^3$ are an alkyl group having from 1 to 6 carbon atoms, an alkoxy group having from 1 to 6 carbon atoms, a chlorine atom or a fluorine atom.

In formula (I), the cyclic amino group represented by $R^4$ is represented by the formula

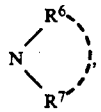

wherein $R_6$ and $R_7$ each represents an alkylene group. The cyclic amino group may be substituted, preferably, by an alkyl group having from 1 to 10 carbon atoms, an alkenyl group having from 1 to 10 carbon atoms, an alkynyl group having from 1 to 10 carbon atoms, an aryl group having from 6 to 10 carbon atoms, an alkoxy group having from 1 to 10 carbon atoms and a halogen atom including a fluorine atom, a chlorine atom and a bromine atom. $R^4$ is preferably a cyclic amino group having from 2 to 12 carbon atoms, and particularly preferably a cyclic amino group having from 3 to 7 carbon atoms. A substituted or unsubstituted pyrrolidine ring as the group represented by $R^4$ is preferable for obtaining a sharp black color tone. The pyrrolidine ring may be substituted by an alkyl group having from 1 to 4 carbon atoms.

In formula (I), the group represented by $R^5$ may be substituted by an alkyl group having from 1 to 10 carbon atoms, an alkenyl group having from 1 to 10 carbon atoms, an alkynyl group having from 1 to 10 carbon atoms, an aryl group having from 6 to 10 carbon atoms, a substituted amino group having from 1 to 12 carbon atoms, an alkoxy group having from 1 to 10 carbon atoms, an aryloxy group having from 6 to 10 carbon atoms, an alkylthio group having from 1 to 10 carbon atoms, a halogen atom including a fluorine atom, a chlorine atom and a bromine atom, a nitro group, a cyano group, or a hetero ring selected from tetrahydrofurfuryl

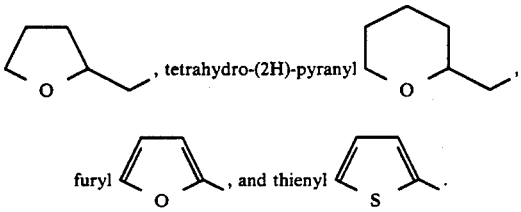

A substituted amino group is preferably an amino group substituted by an alkyl group having from 1 to 12 carbon atoms, an aryl group having from 6 to 10 carbon atoms or an acyl group having from 2 to 10 carbon atoms. $R^5$ preferably represents an alkyl group having from 1 to 12 carbon atoms, an aryloxyalkyl group having from 7 to 12 carbon atoms, an alkoxyalkyl group having from 2 to 12 carbon atoms, and a halogen-substituted alkyl group having from 1 to 12 carbon atoms.

Specific nonlimiting examples of the leuco dye of the present invention are listed below.

9-(2-methoxycarbonylphenyl)-2-(1-pyrrolidinyl)-3-methyl-6-diethylaminoxanthene, 9-(2-methoxycarbonylphenyl)-2-(1-pyrrolidinyl)-3-methyl-6-diethylaminoxanthene, 9-(2-butoxycarbonylphenyl)-2-(1-pyrrolidinyl)-3-methyl-6-diethylaminoxanthene, 9-(2-hexyloxycarbonylphenyl)-2-(1-pyrrolidinyl)-3-methyl-6-diethylaminoxanthene, 9-(2-methoxycarbonylphenyl)-2-(1-pyrrolidinyl)-3-chloro-6-diethylaminoxanthene, 9-(2-ethoxycarbonylphenyl)-2-(1-pyrrolidinyl)-3-chloro-6-diethylaminoxanthene, 9-(2-butoxycarbonylphenyl)-2-(1-pyrrolidinyl)-3-chloro-6-diethylaminoxanthene, 9-(2-hexyloxycarbonylphenyl)-2-(1-pyrrolidinyl)-3-chloro-6-diethylaminoxanthene, 9-(2-methoxycarbonylphenyl)-2-(1-pyrrolidinyl)-3-methoxy-6-diethylaminoxanthene, 9-(2-ethoxycarbonylphenyl)-2-(1-pyrrolidinyl)-3-methoxy-6-diethylaminoxanthene, 9-(2-ethoxycarbonylphenyl)-2-(1-pyrrolidinyl)-3-fluoro-6-diethylaminoxanthene, 9-(2-methoxycarbonylphenyl)-2-(1-pyrrolidinyl)-3-ethyl-6-diethylaminoxanthene, 9-(2-methoxycarbonylphenyl)-2-[1-(2-methylpyrrolidinyl)]-3-methyl-6-diethylaminoxanthene, 9-(2-methoxycarbonylphenyl)-2-[1-(2,5-dimethylpyrrolidinyl)]-3-methyl-6-diethylaminoxanthene, 9-(2-methoxycarbonylphenyl)-2-(1-pyrrolidinyl)-3-methyl-6-dibutylaminoxanthene, 9-(2-methoxycarbonylphenyl)-2-(1-pyrrolidinyl)-3-methyl-6-N-isoamyl-N-ethylaminoxanthene, 9-(2-methoxycarbonylphenyl)-2-(1-pyrrolidinyl)-3-methyl-6-N-tetrafurfuryl-N-ethylaminoxanthene, 9- (2-methoxycarbonylphenyl)-2-(1-pyrrolidinyl)-3-methyl-6-N-(3-ethoxypropyl)-N-ethylaminoxanthene and 9-(2-benzyloxycarbonylphenyl)-2-(1-pyrrolidinyl)-3-methyl-6-diethylaminoxanthene.

The leuco dye of the present invention is coated in an amount of from 0.05 to 0.40 g/m$^2$.

In accordance with the present invention, a leuco dye compound having a different skeleton may be used in combination with the leuco dye of the present invention in order to adjust the color tone. The compound which may be used in combination with the leuco dye of the present invention preferably includes those described in U.S. Pat. No. 3,445,234. Such compound is used in a molar ratio to the leuco dye of the present invention of from 99.9 : 0.1 to 90 : 10.

Specifically mentioned are: leuco Crystal Violet, tris-(4-diethylamino-o-tolyl)-methane, bis-(4-diethylamino-o-tolyl)-phenylmethane, bis-(4-diethylamino-o-tolyl)-thienyl-2-methane, bis-(2-chloro-4-diethylaminophenyl)-phenylmethane, 2-(2-chlorophenyl)amino-6-N,N-dibutylamino-9-(2-methoxycarbonyl)-phenylxanthene, 2-N,N-dibenzylamino-6-N,N-diethylamino-9-(2-methoxycarbonyl)-phenylxanthene, benzo[a]-6-N,N-diethylamino-9-(2-methoxycarbonyl)-phenylxanthene, 2-(2-chlorophenyl)-amino-6-N,N-dibutylamino-9-(2-methylphenylcarboxamido)-phenylxanthene, 3,6-dimethoxy-9-(2-methoxycarbonyl)-phenylxanthene, 3,6-diethoxyethyl-9-(2-methoxycarbonyl)-phenylxanthene, benzoyl leuco methylene blue and 3,7-bis-diethylaminophenoxazine.

On the other hand, the photo-oxidizing agent contained in the light image-forming material of the present invention is inactive under conditions that it is not exposed to light to maintain unexcited state, but forms a chemical species which oxidizes a leuco dye to its color-developing form when exposed to an active radiation ray such as visible light, ultraviolet light, infrared light, and an X-ray.

Photo-oxidizing agents for use in the present invention include lophine dimer compounds such as the 2,4,5-triarylimidazole dimer disclosed in JP-B 62-39728 (corresponding to U.S. Pat. No. 4,247,618), JP-B 63-2099 (corresponding to U.S. Pat. No. 4,311,783 and 4,252,887); azide compounds such as 2-azidobezoxazole, benzoyl azide and 2-azidobenzimidazole as disclosed in U.S. Pat. No. 3,282,693; pyridinium compounds such as 3-ethyl-1-methoxy-2-pyridothiacyanine perchlorate and 1-methoxy-2-methylpyridinium p-toluenesulfonate as disclosed in U.S. Pat. No. 3,615,568; organic halogen compounds such as N-bromosuccinimide, tribromomethyl phenyl sulfone, 2-trichloromethyl-5-(p-butoxystyryl)-1,3,4-oxadiazole and 2,6-ditrichloromethyl-4-(p-methoxyphenyl)-triazine and azido polymers as described in Shunki Kenkyu Happyokai Koen Yoshi, ed. Nippon Shashin Gakkai, (the preprint of the Spring Meeting of Japan Photography Society) page 55 (1968). Among them, lophine dimers and organic halogen compounds are preferable, and combinations of these photo-oxidizing agents are particularly preferable for high sensitization. The molar ratio of the content of the lophine dimers to that of the organic halogen compounds is preferably in the range of from 99.9 : 0.1 to 30 : 70, more preferably from 90 : 10 to 50 : 50.

The ratio of the content of the leuco dye to that of the photo-oxidizing agent per unit area of the recording layer of the light image-forming material of the present invention is preferably in the range of from 10:1 to 1:10, more preferably from 2:1 to 1:5 on a molar ratio basis.

The reducing agent for use in the present invention is a free radical scavenger which traps a free radical of the activated photo-oxidizing agent. Specific examples of the reducing agents include hydroquinone compounds and aminophenol compounds having a hydroxy group on the benzene ring and another hydroxy group or an amino group at the second position of the benzene ring as disclosed in U.S. Pat. No. 3,042,515; cyclic phenyl hydrazide compounds as disclosed in JP-B 62-39728 (corresponding to U.S. Pat. No. 4,247,618); compounds selected from guanidine derivatives, alkylenediamine derivatives and hydroxyamine compounds. These compounds can be used alone or in combination of two or more thereof. The reducing agent, however, is not limited to the above examples, and may be any reducing agent as long as it is effective with the selected photo-oxidizing agent.

In the light image-forming material of the present invention, the reducing agent is dispersed in a solid form by means of a sand mill or the like in the coating solution, or dissolved in oil and dispersed to form an emulsion. A protective colloid is preferably added to the coating solution containing the solid dispersion or the emulsified dispersion.

The reducing agent is contained per unit area of the recording layer in an amount of from 1 to 100 moles, preferably from 2 to 20 moles per mole of the photo-oxidizing component.

The recording layer of the light-sensitive image-forming material of the present invention may contain a binder. Specific examples thereof include polyvinyl alcohol, methyl cellulose, carboxymethyl cellulose, hydroxypropyl cellulose, gum arabic, gelatin, polyvinyl pyrrolidone, casein, styrenebutadiene latex, acrylonitoryl-butadiene latex, polyvinyl acetate, polyacrylate and ethylene-vinyl acetate copolymer.

The coating amount of the binder ranges preferably 0.8 $g/m^2$ to 2.5 $g/m^2$.

The image-forming material of the present invention is described in further detail below.

The light image-forming material of the present invention comprises a support having thereon a recording layer essentially containing a leuco dye, a photo-oxidizing agent and a reducing agent. One or two of these essential components are preferably incorporated in a microcapsule. Preferably the leuco dye, the leuco dye and the photo-oxidizing agent, or the reducing agent is contained within the same microcapsule. Particularly preferably, the leuco dye and the photo-oxidizing agent are contained within the same microcapsule.

The capsule material for use in the present invention preferably prevents mutual contact of a substance contained in the microcapsule with another substance arranged outside the microcapsule by the isolating action of the microcapsule wall at ordinary temperatures (e.g. room temperature or storage temperature). The capsule material has an increased permeability for the substance (contained therein or arranged outside the microcapsule) upon heating to a certain temperature or higher temperature. The permeation initiation temperature can be controlled by suitably selecting a capsule wall material, a capsule core material, and an additive. Useful wall materials include polyurethanes, polyureas, polyamides, polyesters, polycarbonates and the like, with polyurethanes and polyureas being particularly preferable.

The microcapsule is formed by emulsifying a core material containing, e.g., a light-sensitive image-forming substance such as a leuco dye and a photo-oxidizing agent and subsequently forming a wall around the emulsified oil drop. In the preparation of the microcapsule, a reactant which forms the wall is added to the inside or the outside of the oil drop. Specific procedures for forming microcapsules are described, for example, in U.S. Pat. Nos. 3,726,804, 3,796,696 and 4,962,009, which patent publications are specifically incorporated herein by reference.

The organic solvent for dissolving the light-sensitive image-forming substance is an oil having a high boiling point. Specific examples include phosphoric acid esters, phthalic acid esters, acrylic acid esters, methacrylic acid ester, other carboxylic acid esters, fatty acid amides, alkylated biphenyls, alkylated terphenyls, alkylated naphthalene, diarylethanes, chlorinated paraffins, and the like.

An auxiliary solvent having a low boiling point may be added to the above-described organic solvent. Specific examples of the auxiliary solvent include ethyl acetate, isopropyl acetate, butyl acetate, methylene chloride, cyclohexanone, etc.

A protective colloid or a surface active agent may be added to the aqueous phase for stabilizing the emulsified oil drop. Water-soluble polymers are generally usable as the protective colloid. Among them, carboxyl-modified polyvinyl alcohol is preferably used for improving water resistance.

The microcapsule preferably has a volume of not more than 20 $\mu m^3$, more preferably not more than an average volume of 4 $\mu m^3$, particularly in view of improvement of image resolution and ease of handling.

An acidic substance may be added into the core material of capsule of the present invention. Examples of the acidic substance include mineral acids such as hydrochloric acid, hydrobromic acid, sulfuric acid, nitric acid, and phosphoric acid; aromatic sulfonic acid and derivatives thereof such as p-toluenesulfonic acid, benzenesulfonic acid, chlorobenzenesulfonic acid, nitrobenzenesulfonic acid, dodecylbenzenesulfonic acid, and naphthalenesulfonic acid; aromatic carboxylic acids and derivatives thereof such as benzoic acid, chlorobenzoic acid, nitrobenzoic acid, hydroxybenzoic acid, toluic acid, salicylic acid, butylsalicylic acid, amylsalicylic acid, phenylsalicylic acid, and naphthoic acid; and salts thereof.

A known sensitizing agent, an ultraviolet absorbing agent, or an antioxidizing agent may be added to the coating liquid of the recording layer without any disadvantage.

The light-sensitive image-forming material of the present invention can be prepared, for example, by coating a dispersion of microcapsules containing a leuco dye and a photo-oxidizing agent as a core material, and a reducing agent (arranged outside the microcapsules) onto a support as described, for example, in U.S. Pat. No. 4,962,009.

The above-described dispersion (i.e., coating liquid) of microcapsules containing the leuco dye and the photo-oxidizing agent and the reducing agent may contain a binder as described in U.S. Pat. No. 3,630,736, a pigment, a wax, a metal soap, a surfactant, a melting point-lowering agent such as p-benzyloxyphenol or p-toluenesulfonamide, and an acidic substance. The light-sensitive image-forming layer (i.e., recording layer) of the present invention is preferably coated in an amount of from 3 to 30 g/m$^2$, particularly preferably from 5 to 20 g/m$^2$ based on the solids content.

A material suitable for the support of the present invention includes a variety of paper from tissue paper to cardboard, regenerated cellulose, cellulose acetate, cellulose nitrate, polyethylene terephthalate, polyethylene, polyvinyl acetate, polymethyl methacrylate, polyvinyl chloride, etc. as described in U.S. Pat. No. 3,445,234.

The coating liquid may be applied onto the support by means of air knife coating, curtain coating, slide coating, roller coating, dip coating, wire bar coating, blade coating, gravure coating, spin coating, extrusion coating, etc. The method of coating, however, is not particularly limited.

If necessary, a subbing layer may be provided on the support, or a protective layer may be provided on the light-sensitive image-forming layer (i.e., recording layer). The subbing layer and the protective layer contain a binder and/or a pigment.

An image is formed on the light-sensitive image-forming material of the present invention generally by imagewise exposure to form a colored image and subsequent thermal fixation, or by hot image printing and subsequent color development. Both methods are useful. The process for forming images are described in detail in U.S. Patent 4,962,009.

In the former method, the image is fixed effectively by heating to bring the photo-oxidizing agent into contact with the reducing agent through the capsule wall. Simultaneous heating and pressing may exhibit a synergistic effect.

With certain microcapsules, fixation can be conducted only by pressing.

Any suitable light sources may be used for activation of the photo-oxidizing agent and image formation of the leuco dye. Useful conventional light sources include a fluorescent lamp, a mercury lamp, a metal halide lamp, a xenon lamp, a tungsten lamp, etc.

The heating may be conducted as described in U.S. Pat. No. 4,962,009 or in various manner. Generally, heating is conducted by use of a thermal head, a hot roller, a hot stamp, a hot plate, etc.

The following examples further illustrate the present invention but should not be construed as limiting the invention in any way. The term "parts" as used below indicates an addition amount based on weight.

EXAMPLE 1

Three parts of 9-(2-methoxycarbonylphenyl)-2-(1-pyrrolidinyl)-3-methyl-6-diethylaminoxanthene; 3 parts of 2,2-bis-(o-chlorophenyl)-4,4',5,5'-tetraphenylbiimidazole; 0.6 part of tribromomethyl phenyl sulfone; 0.4 part of 2,5-di-tertiaryoctylhydroquinone; and 24 parts of a 75% (by weight) solution of xylylene diisocyanate/trimethylol propane adduct in ethyl acetate were dissolved in a mixed solvent of 22 parts of methylene chloride and 24 parts of tricresyl phosphate. The resulting solution was added to 63 parts of an aqueous 8% (by weight) solution of carboxyl-modified polyvinyl alcohol, and dispersed and emulsified at 20° C. to prepare a liquid emulsion having an average particle diameter of 1 μm. To the resulting emulsion, 100 parts of water was added, and stirred at 40° C. for 3 hours. Thereafter, the emulsion was brought to room temperature, and filtered to obtain a capsule liquid dispersion.

Separately, 30 parts of 1-phenylpyrazolidine-3-on (phenidone A) was added to 150 parts of aqueous 4% (by weight) carboxyl-modified polyvinyl alcohol solution and dispersed by means of a lateral sand mill to prepare a phenidone A liquid dispersion having an average particle diameter of 1 μm.

The coating liquid having the following composition was prepared.

| | |
|---|---|
| Capsule dispersion as prepared above, | 33.3 parts |
| Phenidone A as liquid dispersion prepared above, | 33.3 parts |
| 20% Silica dispersion (Siloid 404, made by Fuji Davidson Kagaku K.K.) | 20 parts |
| 30%-epoxidized polyamide resin (FL-71, made by Toho Kagaku K.K.) | 15 parts |
| Aqueous 3% polyethylene glycol lauryl ether solution | 10 parts |

This coating liquid was coated on a sheet of wove paper (basis weight 76 g/m$^2$) in a solids content of 10 g/m$^2$ by means of a coating rod, and dried at 50° C. to prepare a light-sensitive image-forming material.

The light-sensitive image-forming material thus prepared was exposed to light projected from Jet Light (ultrahigh pressure mercury lamp, made by Ohku K.K.) through a line-picture sheet, to obtain a sharp black image. The sample was then passed through heating rollers at 120° C. to fix the image. Thereafter, the sample was blanket exposed to light by use of the Jet Light in an intensity five times that used for imagewise exposure. As a result, no change was observed in the image. The resulting image had good stability.

EXAMPLES 2 and 3

Light-sensitive image-forming materials were prepared in the same manner as in Example 1 except that 9-(2-methoxycarbonylphenyl)-2-(1-pyrrolidinyl)-3-chloro-6-diethylaminoxanthene (Example 2) or 9-(2-methoxycarbonylphenyl)-2-(1-pyrrolidinyl)-3-methoxy-6-diethylaminoxanthene (Example 3) was used in place of 9-(2-methoxycarbonylphenyl)-2-(1-pyrrolidinyl)-3-methyl-6-diethylaminoxanthene as in Example 1.

The light-sensitive image-forming materials thus prepared were imagewise-exposed to form a sharp black image, fixed by heating and evaluated in the same manner as in Example 1.

Thereafter, the samples were blanket exposed to light by use of Jet Light in an intensity five times that used for imagewise exposure. As a result, no change was observed in the image. The resulting image had good stability.

While the invention has been described in detail and with reference to specific examples thereof, it will be apparent to one skilled in the art that various changes and modifications can be made therein without departing from the spirit and scope thereof.

What is claimed is:

1. A light-sensitive image-forming material comprising a support having thereon a recording layer containing a leuco dye which forms color upon oxidative development, a photo-oxidizing agent, and a reducing agent, wherein the leuco dye is represented by formula (I):

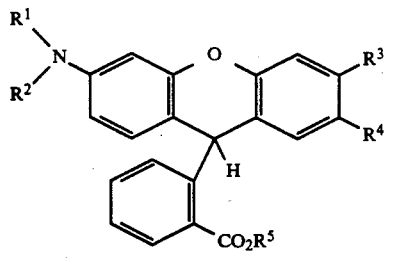

(I)

wherein $R^1$ and $R^2$, which may be the same or different, each represents an alkyl group, an alkenyl group, an alkynyl group, or an aryl group; $R^3$ represents an alkyl group, an alkoxy group, an aryl group or a halogen atom; $R^4$ represents a pyrrolidinyl group; and $R^5$ represents an alkyl group.

2. A light-sensitive image-forming material as in claim 1, wherein $R^1$ and $R^2$ are selected from —H, —$CH_3$, $C_nH_{2n-1}YZ$,

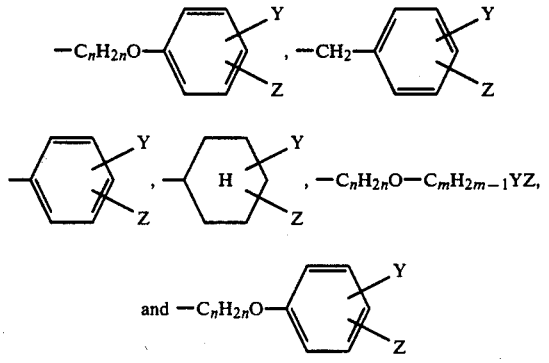

wherein n is an integer of from 2 to 10; m is an integer of from 1 to 5; and Y and Z may be same or different, each represent an alkyl group, an alkenyl group, an alkynyl group, an aryl group, a hydrogen atom, a substituted amino group, an alkoxy group, a hydrogen atom, a substituted amino group, an alkoxy group, an aryloxy group, an alkylthio group, a halogen atom, a nitro group or a cyano group.

3. A light-sensitive image-forming material as in claim 1, wherein $R^3$ is an alkyl group having from 1 to 15 carbon atoms, an alkoxy group having from 1 to 15 carbon atoms, a chlorine atom, or a fluorine atom.

4. A light-sensitive image-forming material as in claim 1, wherein $R^5$ is an alkyl group having from 1 to 12 carbon atoms, an aryloxyalkyl group having from 7 to 12 carbon atoms, an alkoxyalkyl group having from 2 to 12 carbon atoms, and a halogen-substituted alkyl group having from 1 to 12 carbon atoms.

5. A light-sensitive image-forming material as in claim 1, wherein said leuco dye is selected from 9-(2-methoxycarbonylphenyl)-2-(1-pyrrolidinyl)-3-methyl-6-diethylaminoxanthene, 9-(2-methoxycarbonylphenyl)-2-(1-pyrrolidinyl)-3-methyl-6-diethylaminoxanthene, 9-(2-butoxycarbonylphenyl)-2-(1-pyrrolidinyl)-3-methyl-6-diethylaminoxanthene, 9-(2-hexyloxycarbonylphenyl)-2-(1pyrrolidinyl)-2-(1-pyrrolidinyl-3-methyl-6-diethylaminoxanthene, 9-(2-methoxycarbonylphenyl)-2-(1-pyrrolidinyl)-3-chloro-6-diethylaminoxanthene, 9-(2-ethoxycarbonylphenyl)-2-(1-pyrrolidinyl)-3-chloro-6-diethylaminoxanthene, 9-(2-butoxycarbonylphenyl)-2-(1-pyrrolidinyl)-3-chloro-6-diethylaminoxanthene, 9-(2-hexyloxycarbonylphenyl)-2-(1-pyrrolidinyl)-3-chloro-6-diethylaminoxanthene, 9-(2-methoxycarbonylphenyl)-2-(1-pyrrolidinyl)-3-methoxy-6-diethylaminoxanthene, 9-(2-ethoxycarbonylphenyl)-2-(1-pyrrolidinyl)-3-methoxy-6-diethylaminoxanthene, 9-(2-ethoxycarbonylphenyl)-2-(1-pyrrolidinyl)-3-fluoro-6-diethylaminoxanthene, 9-(2-methoxycarbonylphenyl)-2-(1-pyrrolidinyl)-3-ethyl-6-diethylaminoxanthene, 9-(2-methoxycarbonylphenyl)-2-[1-(2-methylpyrrolidinyl)]-3-methyl-6-diethylaminoxanthene, 9-(2-methoxycarbonylphenyl)-2-[1-(2,5-dimethylpyrrolidinyl)]-3-methyl-6-diethylaminoxanthene, 9-(2-methoxycarbonylphenyl)-2-(1-pyrrolidinyl)-3-methyl-6-dibutylaminoxanthene, 9-(2-methoxycarbonylphenyl)-2-(1-pyrrolidinyl)-3-methyl-6-N-isoamyl-N-ethylaminoxanthene, 9-(2-methoxycarbonylphenyl)-2-(1-pyrrolidinyl)-3-methyl-6-N-tetrafurfuryl-N-ethylaminoxanthene, 9-(2-methoxycarbonylphenyl)-2-(1-pyrrolidinyl)-3-methyl-6-N-(3-ethoxypropyl)-N-ethylaminoxanthene and 9-(2-benzyloxycarbonylphenyl)-2-(1-pyrrolidinyl)-3-methyl-6-diethylaminoxanthene.

6. A light-sensitive image-forming material as in claim 1, wherein said recording layer further contains a binder.

7. A light-sensitive image-forming material as in claim 1, wherein the content of the leuco dye to that of the photo-oxidizing agent per unit area of the recording layer is in the range of from 10 : 1 to 1 : 10 on a molar basis.

8. A light-sensitive image-forming material as in claim 1, wherein said reducing agent is contained in the recording layer in an amount of from 1 to 100 mols per mol of the photo-oxidizing agent per unit area of the recording layer.

9. A light-sensitive image-forming material as in claim 1, wherein the leuco dye and the photo-oxidizing agent are contained as a core material within microcapsules, and the reducing agent is arranged in the recording layer outside of the microcapsules.

10. A light-sensitive image-forming material as in claim 1, wherein $R^4$ represents an unsubstituted pyrrolidinyl group.

11. A light-sensitive image-forming material as in claim 1, wherein $R^4$ represents a pyrrolidinyl group substituted by an alkyl group having from 1 to 4 carbon atoms.

* * * * *